US011098927B2

(12) United States Patent
Higashiiue et al.

(10) Patent No.: US 11,098,927 B2
(45) Date of Patent: Aug. 24, 2021

(54) DISTRIBUTOR, HEAT EXCHANGER AND REFRIGERATION CYCLE APPARATUS

(71) Applicant: Mitsubishi Electric Corporation, Tokyo (JP)

(72) Inventors: Shinya Higashiiue, Tokyo (JP); Takehiro Hayashi, Tokyo (JP); Yohei Kato, Tokyo (JP); Shigeyoshi Matsui, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 103 days.

(21) Appl. No.: 16/336,673

(22) PCT Filed: Dec. 21, 2016

(86) PCT No.: PCT/JP2016/088136
§ 371 (c)(1),
(2) Date: Mar. 26, 2019

(87) PCT Pub. No.: WO2018/116413
PCT Pub. Date: Jun. 28, 2018

(65) Prior Publication Data

US 2020/0072507 A1 Mar. 5, 2020

(51) Int. Cl.
*F25B 1/00* (2006.01)
*F25B 39/00* (2006.01)
(Continued)

(52) U.S. Cl.
CPC ..... *F25B 1/00* (2013.01); *F25B 39/00* (2013.01); *F25B 39/028* (2013.01);
(Continued)

(58) Field of Classification Search
CPC ..... F25B 1/00; F25B 39/00; F25B 39/028; F25B 39/04; F25B 13/00; F28D 2021/0068; F28F 9/0221; F28F 9/0278; F24H 9/146
See application file for complete search history.

(56) References Cited

U.S. PATENT DOCUMENTS

2007/0251682 A1 11/2007 Sasaki
2016/0116231 A1* 4/2016 Higashiiue ..... F25B 39/00 165/174
2016/0195335 A1 7/2016 Nishiyama et al.

FOREIGN PATENT DOCUMENTS

EP 2 998 681 A1 3/2016
EP 2 998 682 A1 3/2016
(Continued)

OTHER PUBLICATIONS

International Search Report of the International Searching Authority dated Mar. 14, 2017 for the corresponding international application No. PCT/JP2016/088136 (and English translation).
(Continued)

*Primary Examiner* — Emmanuel E Duke
(74) *Attorney, Agent, or Firm* — Posz Law Group, PLC

(57) ABSTRACT

A distributor includes: a fluid inlet; a plurality of fluid outlets; a distribution flow passage which causes the fluid inlet to communicate with the fluid outlets, and distributes fluid which flows into the distribution flow passage through the fluid inlet, among the fluid outlets; and a plurality of heat-transfer-tube insertion portions each formed to face an associated one of the fluid outlets, the heat-transfer-tube insertion portions allowing heat transfer tubes to be inserted therein. The heat transfer tubes are inserted in the heat-transfer-tube insertion portions such that an end portion of each of the heat transfer tuber is connected to the associated fluid outlet.

11 Claims, 9 Drawing Sheets

(51) Int. Cl.

| | |
|---|---|
| ***F25B 39/02*** | (2006.01) |
| *F28D 21/00* | (2006.01) |
| *F28F 9/02* | (2006.01) |

(52) U.S. Cl.
CPC .... *F28D 2021/0068* (2013.01); *F28F 9/0221* (2013.01); *F28F 9/0278* (2013.01)

(56) References Cited

FOREIGN PATENT DOCUMENTS

| | | | | |
|---|---|---|---|---|
| EP | 2998682 | A1 * | 3/2016 | ..... F28F 9/028 |
| EP | 3 018 441 | A1 | 5/2016 | |
| JP | H07-035438 | A | 2/1995 | |
| JP | 2007-298197 | A | 11/2007 | |
| WO | 2014/184913 | A1 | 11/2014 | |
| WO | 2015/004719 | A1 | 1/2015 | |
| WO | WO-2015004719 | A1 * | 1/2015 | ..... F28F 9/0221 |

OTHER PUBLICATIONS

Office Action dated Mar. 10, 2020 issued in corresponding JP patent application No. 2018-557459 (and English translation).
Extended European Search Report dated Nov. 26, 2019 issued in corresponding EP patent application No. 16924512.3.
Office Action dated Jul. 3, 2020 issued in corresponding CN patent application No. 201680090720.9 (and English translation).

* cited by examiner

DISTRIBUTOR, HEAT EXCHANGER AND REFRIGERATION CYCLE APPARATUS

CROSS REFERENCE TO RELATED APPLICATION

This application is a U.S. national stage application of PCT/JP2016/088136 filed on Dec. 21, 2016, the contents of which are incorporated herein by reference.

TECHNICAL FIELD

The present invention relates to a distributor for use in, for example, a thermal circuit, a heat exchanger, and a refrigeration cycle apparatus.

BACKGROUND ART

A heat exchanger includes flow passages (paths) which are formed by arranging a plurality of heat transfer tubes in parallel to reduce the pressure loss of refrigerant which flows through the heat transfer tubes. At refrigerant inlet portions of the heat transfer tubes, for example, a header or a distributor is provided as a distributing device which evenly distributes the refrigerant among the heat transfer tubes.

It is important that the refrigerant be evenly distributed among the heat transfer tubes, in order to ensure a high heat transfer performance of the heat exchanger.

In a distributor proposed as such a distributor as described above, a plurality of plate-shaped bodies are stacked together to form a distribution flow passage in which a single inlet flow passage is provided in such a way as to branch into a plurality of outlet flow passages, thereby causing refrigerant to be distributed among heat transfer tubes of a heat exchanger (see, for example, Patent Literature 1).

The distributor described in Patent Literature 1 includes bare and clad elements which are alternately stacked together; and the bare elements are plate-shaped bodies to which no brazing material is applied, and the clad elements are plate-shaped bodies to which a brazing material is applied. End portions of the heat transfer tubes are inserted into an outermost side of the distributor in the stacking direction of the elements.

CITATION LIST

Patent Literature

Patent Literature 1: International Publication No. 2015/004719

SUMMARY OF INVENTION

Technical Problem

In the distributor described in Patent Literature 1, the distribution flow passage formed therein is provided separate from space into which the heat transfer tubes are inserted. That is, the distributor described in Patent Literature 1 requires plate-shaped bodies which have space allowing the heat transfer tubes to be inserted therethrough. As the number of plate-shaped bodies is increased, the distributor is made larger. However, it is required that distributors, which include distributors in which plate-shaped bodies are not stacked, are made smaller. Actually, they can still be made smaller.

The present invention has been made in view of the above circumstances, and an object of the present invention is to provide a smaller distributor, a smaller heat exchanger and a smaller refrigeration cycle apparatus.

Solution to Problem

A distributor according to one embodiment of the present invention includes: a fluid inlet; a plurality of fluid outlets; a distribution flow passage which causes the fluid inlet to communicate with the fluid outlets, and distributes fluid which flows into the distribution flow passage through the fluid inlet, among the fluid outlets; and a plurality of heat-transfer-tube insertion portions each formed to face an associated one of the fluid outlets, the heat-transfer-tube insertion portions allowing heat transfer tubes to be inserted therein. The heat transfer tubes are inserted in the heat-transfer-tube insertion portions such that an end portion of each of the heat transfer tubes is connected to the associated fluid outlet.

A heat exchanger according to another embodiment of the present invention includes the above distributor and a plurality of heat transfer tubes into which the fluid flows after flowing out through the fluid outlets of the distributor.

A refrigeration cycle apparatus according to still another embodiment of the present invention includes the above heat exchanger, which functions as at least one of an evaporator and a condenser.

Advantageous Effects of Invention

In the distributor according to one embodiment of the present invention, the end portions of the heat transfer tubes are connected to the fluid outlets. By applying this configuration, the length of the distributor in the flow direction of the fluid can be reduced, and the size of the distributor can thus be reduced.

The heat exchanger according to another embodiment of the present invention includes the above distributor. Therefore, at least the size of the heat exchanger can be reduced.

The refrigeration cycle apparatus according to still another embodiment of the present invention includes the above heat exchanger. Therefore, at least the size of the refrigeration cycle apparatus can be reduced.

DESCRIPTION OF EMBODIMENTS

A distributor, a heat exchanger and a refrigeration cycle apparatus according to the present invention will be described with reference to the drawings.

The configurations, operations, etc., as described below are merely examples, and a distributor, a heat exchanger and a refrigeration cycle apparatus according to the present invention are not limited to those described below. In each of the figures, elements which are the same as or similar to those illustrated in a previous figure are denoted by the same reference signs or no reference signs. Also, descriptions of elements, configurations, etc. which are the same as or similar to previously described ones will be omitted or simplified as appropriate.

The following description is made with respect to the case where a distributor and a heat exchanger according to the present invention are applied to an air-conditioning apparatus, which is an example of a refrigeration cycle apparatus. However, this is not limitative. For example, they may be applied to other types of refrigeration cycle apparatuses which include a refrigerant cycle circuit. Furthermore, the description is also made with respect to the case where the refrigeration cycle apparatus switches the operation to be performed between a heating operation and a cooling operation. However, this is not limitative, that is, the refrigeration cycle apparatus may perform only one of the heating operation and the cooling operation.

Embodiment 1

A distributor and a heat exchanger according to embodiment 1 of the present invention will be described.

<Configuration of Heat Exchanger 1>

The configuration of a heat exchanger 1 according to embodiment 1 will be roughly described.

Figure 1:
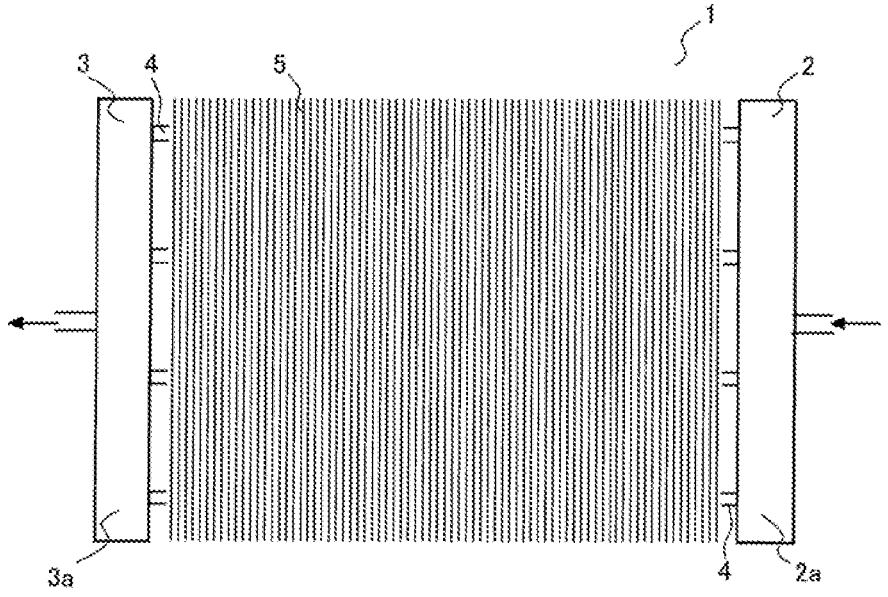
FIG. 1 is a schematic diagram illustrating the configuration of a heat exchanger according to embodiment 1 of the present invention.

FIG. 1 is a schematic diagram illustrating the configuration of the heat exchanger 1 according to embodiment 1. In FIG. 1 and the following figures, the flow direction of refrigerant is indicated by black arrows.

The heat exchanger 1 includes a first distributor 2, a second distributor 3, a plurality of heat transfer tubes 4 and a plurality of fins 5. The second distributor 3 may be of the same type as the first distributor 2 or a different type from that of the first distributor 2.

The first distributor 2 includes at least one distribution flow passage 2*a* provided therein. An inlet side of the distribution flow passage 2*a* is connected to a refrigerant pipe, and an outlet side of the distribution flow passage 2*a* is connected to the heat transfer tubes 4.

The first distributor 2 corresponds to a "distributor" according to the present invention.

In the second distributor 3, a joining flow passage 3*a* is provided. An inlet side of the joining flow passage 3*a* is connected to the heat transfer tubes 4, and an outlet side of the joining flow passage 3*a* is connected to a refrigerant pipe.

The heat transfer tubes 4 are flat or circular tubes in each of which a plurality of flow passages are provided. The heat transfer tubes 4 are made of, for example, aluminum. The fins 5 are joined to the heat transfer tubes 4.

The fins 5 are made of, for example, aluminum. The heat transfer tubes 4 and the fins 5 are joined together by, for example, brazing. Although four heat transfer tubes 4 are illustrated in FIG. 1, the number of heat transfer tubes 4 is not limited to four. In the description regarding embodiment 1, it is assumed by way of example that the heat transfer tubes 4 are flat tubes.

<Flow of Refrigerant in Heat Exchanger>

The flow of refrigerant in the heat exchanger 1 will be described.

Refrigerant which flows through the refrigerant pipe enters the first distributor 2, and is distributed among the heat transfer tubes 4 by the distribution flow passage 2*a*. In the heat transfer tubes 4, the refrigerant exchanges heat with, for example, air send by a fan. Streams of the refrigerant that flow through the heat transfer tubes 4 flows into the joining flow passage 3*a* in the second distributor 3, join each other to combine into the refrigerant, and the refrigerant flows out of the joining flow passage 3*a* into the refrigerant pipe. In the heat exchanger 1, the refrigerant can also flow back, that is, it can also flow in a direction from the second distributor 3 toward the first distributor 2.

<Configuration of First Distributor 2>

The configuration of the first distributor 2 will be described. First of all, it will be described by referring to by way of example the case where the first distributor 2 is a stacking type header.

Figure 2:
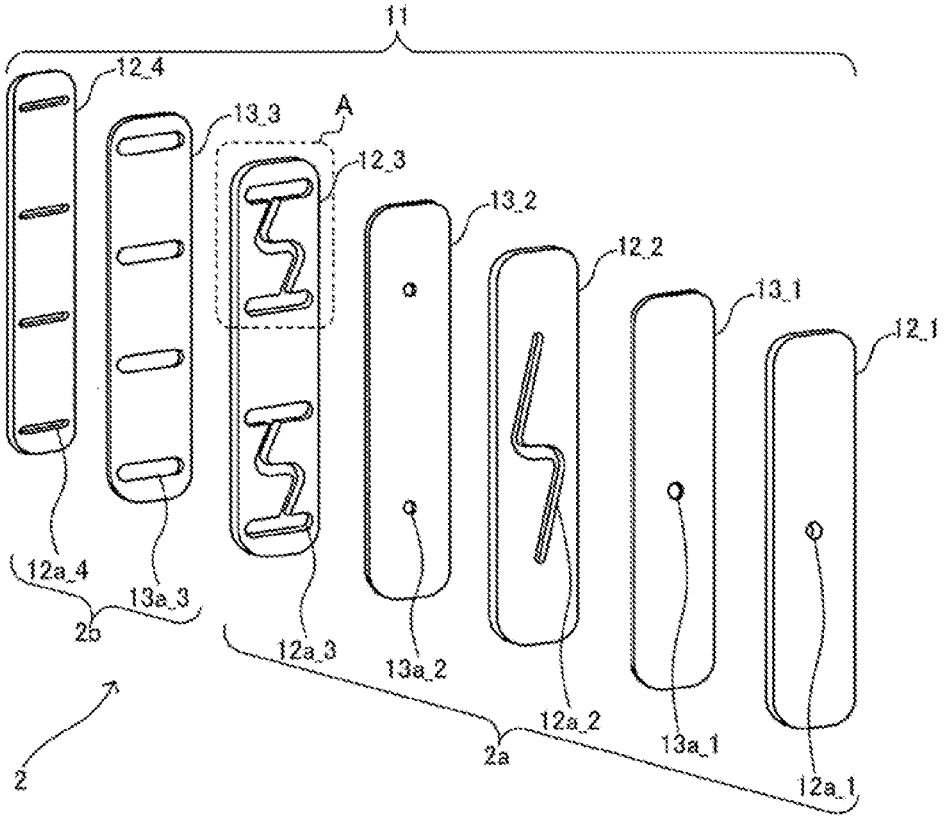
FIG. 2 is an exploded perspective view of a distributor according to embodiment 1 of the present invention.
Figure 3:
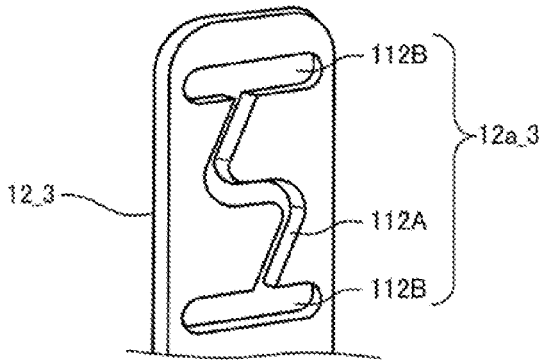
FIG. 3 is an enlarged perspective view of part A indicated in FIG. 2.
Figure 4:
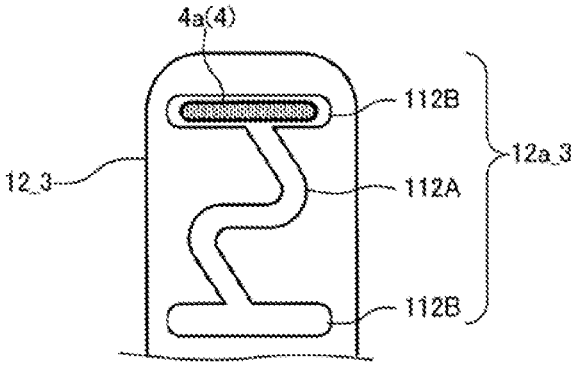
FIG. 4 is an enlarged view of the part A indicated in FIG. 2 as seen from an inlet side of a flow passage.

FIG. 2 is an exploded perspective view of the first distributor 2. FIG. 3 is an enlarged perspective view of part A indicated in FIG. 2. FIG. 4 is an enlarged view of the part A indicated in FIG. 2 as seen from an inlet side of the flow passage. In addition, FIG. 4 also illustrates a heat transfer tube 4.

As illustrated in FIG. 2, the first distributor 2 includes a plate-shaped body 11. The plate-shaped body 11 includes first plate-shaped elements 12_1 to 12_4, which are bare elements, and second plate-shaped elements 13_1 to 13_3, which are clad elements, such that the first plate-shaped elements and the second plate-shaped elements are alternately stacked. The first plate-shaped elements 12_1 and 12_4 are provided at the outermost sides of the plate-shaped body 11 in a stacking direction. In the following description, the first plate-shaped elements 12_1 to 12_4 may be generically referred to as first plate-shaped elements 12; and likewise, the second plate-shaped elements 13_1 to 13_3 may be generically referred to as second plate-shaped elements 13.

The first plate-shaped elements 12 are made of, for example, aluminum. To the first plate-shaped elements 12, no brazing material is applied. In the first plate-shaped elements 12, respective through holes 12*a*_1 to 12*a*_4 are provided to form the distribution flow passage 2*a*. The through holes 12*a*_1 to 12*a*_4 extend through the first plate-shaped elements 12. When the first plate-shaped elements 12 and the second plate-shaped elements 13 are stacked together side by side, the through holes 12*a*_1 to 12*a*_3 serve as part of the distribution flow passage 2*a*.

The through hole 12*a*_1 serves as a fluid inlet for fluid such as refrigerant.

Ends of the through holes 12*a*_3 serve as fluid outlets for the fluid such as the refrigerant.

The through holes 12*a*_4 serve as a heat-transfer-tube insertion portion 2*b*, and thus do not allow the fluid such as the refrigerant to flow therethrough.

The second plate-shaped elements 13 are made of, for example, aluminum, and are thinner than the first plate-shaped elements 12. To at least front and back surfaces of the second plate-shaped elements 13, brazing material is applied. Through holes 13*a*_1 and 13*a*_2 are provided in the second plate-shaped elements 13 to form part of the distribution flow passage 2*a*. The through holes 13*a*_1 to 13*a*_3 extend through the second plate-shaped elements 13. When the first plate-shaped elements 12 and the second plate-shaped elements 13 are stacked together, the through holes 13*a*_1 and 13*a*_2 function as part of the distribution flow passage 2*a*.

The through holes 13*a*_3 function as the heat-transfer-tube insertion portion 2*b*, and thus do not allow the fluid such as the refrigerant to flow therethrough.

The through hole 12*a*_1 provided in the first plate-shaped member 12_1, the through hole 13*a*_1 in the second plate-shaped member 13_1 and the through holes 13*a*_2 in the second plate-shaped member 13_2 extend through the respective plate-shaped members in such a way as to have flow-passage circular cross sections. To the through hole 12*a*_1, which serves as the fluid inlet, the refrigerant pipe is connected. For example, a metal cap or the like may be provided on a surface of the first plate-shaped member 12_1 that is located on a refrigerant inlet side thereof, and the refrigerant pipe may be connected to the metal cap or the like. Alternatively, an inner peripheral surface of the through hole 12*a*_1 may be shaped to allow an outer peripheral surface of the refrigerant pipe to be fitted in the inner peripheral surface of the through hole 12*a*_1, and the refrigerant pipe may be directly connected to the through hole 12*a*_1 without using a metal pipe or the like.

It should be noted that the flow-passage cross section is a cross section of the flow passage which is taken in a direction perpendicular to the flow of the fluid.

The through hole 12*a*_2 provided in the first plate-shaped member 12_2 extends therethrough to have, for example, a flow-passage Z-shaped cross section of the flow passage. The through hole 13*a*_1 of the second plate-shaped member 13_1, which is stacked on a refrigerant inlet side of the first plate-shaped member 12_2, is provided to face the center of the through hole 12*a*_2. The through holes 13*a*_2 of the second plate-shaped member 13_2, which are stacked on a refrigerant outlet side of the first plate-shaped member 12_2, are located to face ends of the through hole 12*a*_2.

Each of the through holes 12*a*_3 provided in the first plate-shaped member 12_3 extends therethough to have a flow-passage cross section formed in the shape of a combination of a Z-shaped portion and linear portions. In the following description, the Z-shaped portion of the flow-passage cross section is referred to as a Z-shaped portion 112A, and the linear portions of the flow-passage cross section are referred to as linear portions 112B.

The linear portions 112B are continuous with the Z-shaped portion 112A at both ends thereof. In other words, the linear portions 112B are provided as opening portions located at ends of the through hole 12*a*_3, i.e., at ends of the distribution flow passage 2*a*, and they correspond to the fluid outlets.

Referring to FIG. 3, an upper end of the Z-shaped portion 112A is continuous with a lower side of an upper one of the linear portions 112B, and a lower end of the Z-shaped portion 112A is continuous with an upper side of a lower one of the linear portions 112B. The two linear portions 112B are parallel to each other. Furthermore, as illustrated in FIG. 4, the opening area of each of the linear portions 112B is greater than the opening area of an end portion 4*a* of each of the heat transfer tubes 4.

The through holes 13*a*_2 of the second plate-shaped member 13_2, which are stacked on the refrigerant inlet side of the first plate-shaped member 12_3, are located to face the respective centers of the through holes 12*a*_3. The through holes 13*a*_3 provided in the second plate-shaped member 13_3, which is stacked on the first plate-shaped member 12_3 and located opposite to the second plate-shaped member 13_2, are located to face the respective linear portions 112B of the through holes 12*a*_3.

When the first plate-shaped elements 12 and the second plate-shaped elements 13 are stacked together, the through holes of the first plate-shaped elements 12 and the through holes of the second plate-shaped elements 13 communicate with each other to form the distribution flow passage 2*a*. To be more specific, when the first plate-shaped elements 12 and the second plate-shaped elements 13 are stacked together, adjacent ones of the through holes communicate with each other, and portions of the first plate-shaped elements 12 and the second plate-shaped elements 13 that are other than the through holes communicating with each other are blocked by those of the first plate-shaped elements 12 and the second plate-shaped elements 13 that are adjacent to the above portions, thereby providing the distribution flow passage 2*a*.

It should be noted that with respect to the first distributor 2, although the distribution flow passage 2*a* is illustrated by way of example as a distribution flow path including a single fluid inlet and four fluid outlets, the number of fluid outlets, that is, the number of branches, is not limited to four.

As illustrated in FIG. 2, the through holes 12*a*_4 provided in the first plate-shaped member 12_4 and the through holes 13*a*_3 provided in the second plate-shaped member 13_3 are located in such a way to face the linear portions 112B located at the ends of the through holes 12*a*_3, and serve as the heat-transfer-tube insertion portions 2*b* into which the end portions 4*a* of the heat transfer tubes 4 are inserted. In other words, the through holes 12*a*_4 and 13*a*_3 are provided to face the linear portions 112B, which are located on extensions of the heat transfer tubes 4. The heat transfer tubes 4 are inserted into the through holes 12*a*_4 and 13*a*_3, and are thereby connected to the first distributor 2.

The end portions 4*a* of the heat transfer tubes 4 may be located either in the through holes 13*a*_3 of the second plate-shaped member 13_3 or in the linear portions 112B of the through holes 12*a*_3 of the first plate-shaped member 12_3. That is, the end portions 4*a* of the heat transfer tubes 4 may be provided in the above manner so as not to contact the second plate-shaped member 13_2.

The inner peripheral surfaces of the through holes 12*a*_4 of the first plate-shaped member 12_4 are fitted in the outer peripheral surfaces of the heat transfer tubes 4. In this case, it is appropriate that the inner peripheral surfaces are fitted in the outer peripheral surfaces with gaps which permit a heated brazing material to infiltrate into the gaps because of capillarity.

<Flow of Refrigerant in First Distributor 2>

The flow of refrigerant in the first distributor 2 will be described.

Figure 5:
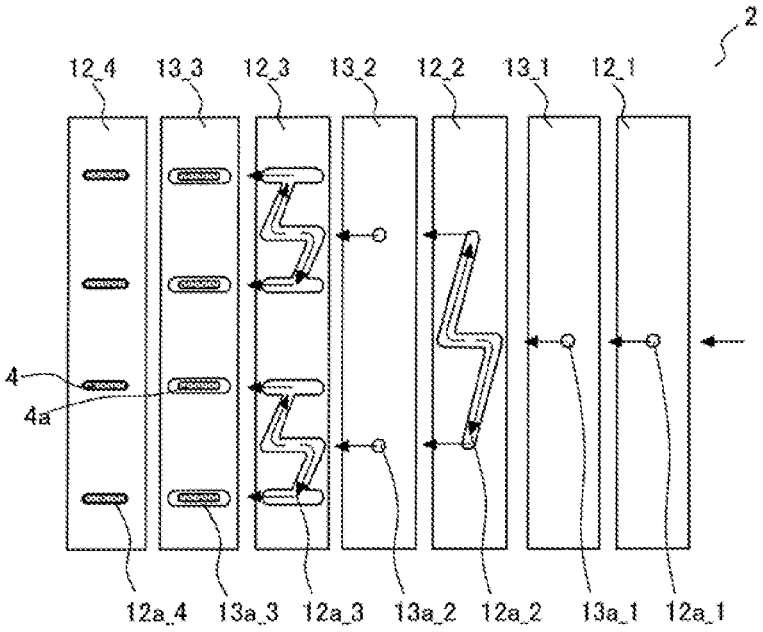
FIG. 5 is a development view of the distributor according to embodiment 1 of the present invention.
Figure 6:
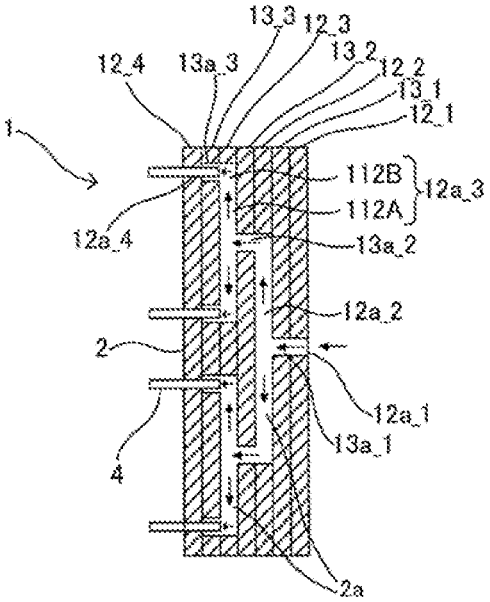
FIG. 6 is a vertical sectional view of the distributor according to embodiment 1 of the present invention.

FIG. 5 is a development view of the first distributor 2. FIG. 6 is a vertical sectional view of the first distributor 2. As a matter of convenience for explanation, FIG. 6 illustrates the plate-shaped bodies having substantially the same thickness. Also, FIG. 6 illustrates a cross section taken in the flow direction of the fluid.

As illustrated in FIGS. 5 and 6, the refrigerant which has flowed through the refrigerant pipe flows into the first distributor 2 through the through hole 12*a*_1 of the first plate-shaped member 12_1, which serves as the fluid inlet. The refrigerant which has flowed through the through hole 12*a*_1 flows into the through hole 13*a*_1 of the second plate-shaped member 13_1.

The refrigerant which has flowed into the through hole 13*a*_1 of the second plate-shaped member 13_1 through the through hole 12*a*_1 of the first plate-shaped member 12_1 flows into the center of the through hole 12*a*_2 of the first plate-shaped member 12_2. The refrigerant which has flowed into the center of the through hole 12*a*_2 of the first plate-shaped member 12_2 flows onto a surface of the second plate-shaped member 13_2, which_is adjacent to the first plate-shaped member 12_2, and is divided into refrigerant streams which flow toward the ends of the through hole 12*a*_2 of the first plate-shaped member 12_2. After reaching the ends of the through hole 12*a*_2 of the first plate-shaped member 12_2, the refrigerant streams flow through the through holes 13*a*_2 of the second plate-shaped member 13_2, and then flow into the centers of the through holes 12*a*_3 of the first plate-shaped member 12_3.

Each of the refrigerant streams having flowed into the centers of the through holes 12*a*_3 of the first plate-shaped member 12_3 flows onto a surface of the second plate-shaped member 13_3, which is stacked on the first plate-shaped member 12_3, and is also divided into further refrigerant streams, which flow toward the ends of an associated one of the through holes 12*a*_3 of the first plate-shaped member 12_3. The linear portions 112B located at the ends of the through holes 12*a*_3 of the first plate-shaped member 12_3 serve as fluid outlets, and the further refrigerant streams which having reached the ends of the through holes 12*a*_3 of the first plate-shaped member 12_3 flow into the heat transfer tubes 4 from the end portions 4*a* of the heat transfer tubes 4 located in the through holes 13*a*_3 or in the through holes 12*a*_3.

The refrigerant streams having flowed into the heat transfer tubes 4 pass through the through holes 13*a*_3 of the second plate-shaped member 13_3 and the through holes 12*a*_4 of the first plate-shaped member 12_4, and flow into regions in which the heat transfer tubes 4 are joined to the fins 5.

The following description is made with respect to the case where the first distributor 2 is an integration type header.

Figure 7:
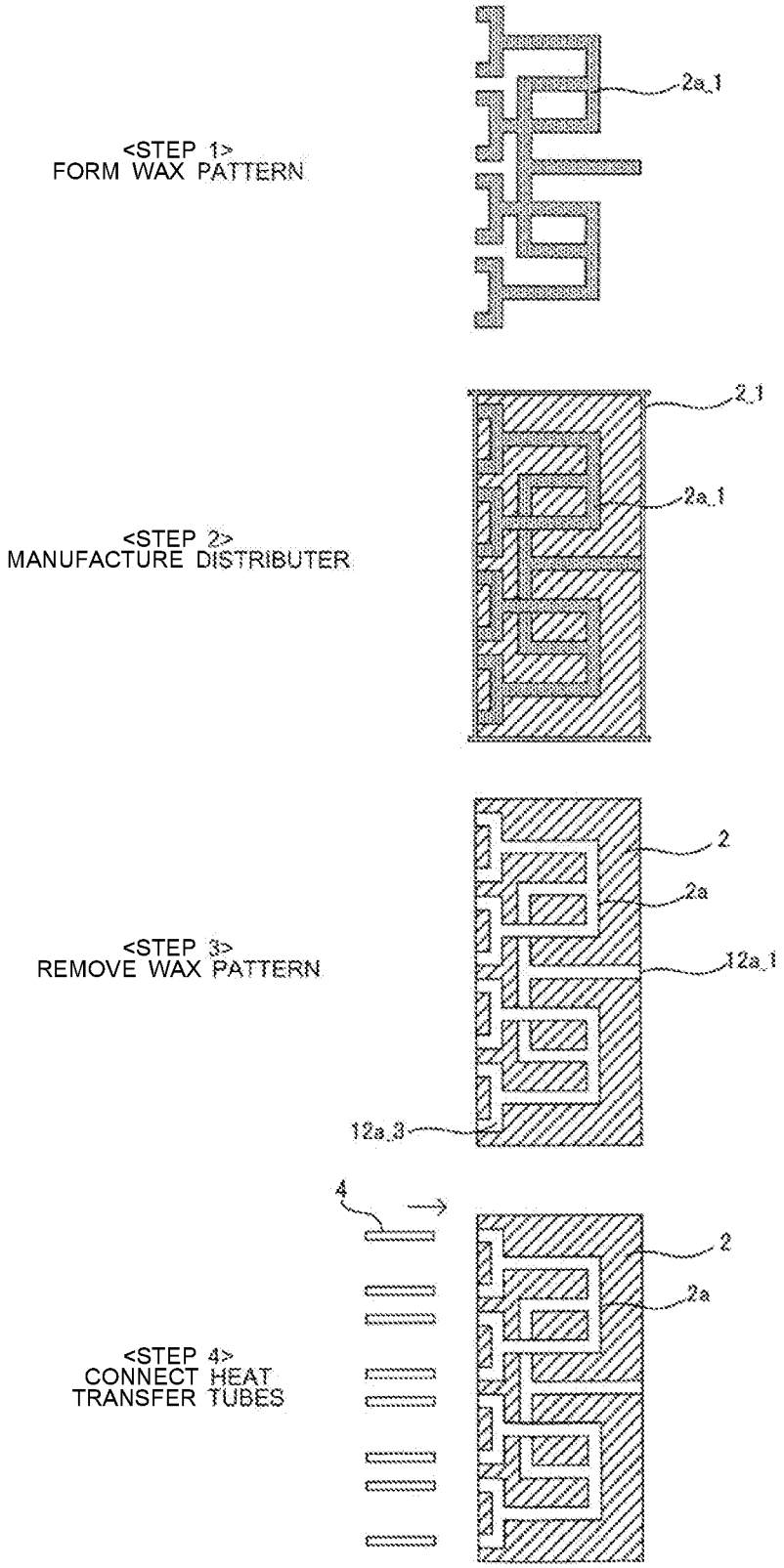
FIG. 7 is a view for explaining steps of a method for manufacturing the heat exchanger according to embodiment 1 of the present invention.

FIG. 7 illustrates steps of a method for manufacturing the heat exchanger 1. First of all, a method for manufacturing the first distributor 2 by applying a lost-wax process will be described.

First, in step 0, a mold for forming the distribution flow passage 2*a* in the first distributor 2 is prepared. In step 1, a wax model (wax pattern 2*a*_1) having the same shape as the distribution flow passage 2*a* is formed by injecting wax into the mold prepared in step 0. In step 2, the wax pattern 2*a*_1 is fixed to a mold 2_1 for forming the first distributor 2, and molten aluminum is injected into the mold 2_1.

Then, in step 3, after solidified, the above aluminum is heated to melt the wax pattern 2*a*_1 fixed therein and cause it to flow out thereof. As a result, the first distributor 2 provided with the distribution flow passage 2*a* is obtained. The first distributor 2 is formed by carrying out steps 0 to 3.

Thereafter, in step 4, the heat transfer tubes 4 are connected to the first distributor 2, and other assembling and processing are performed to form the heat exchanger 1.

The first distributor 2 manufactured by the lost-wax process does not include the plate-shaped body 11. In this regard, it is different from the first distributor 2 as illustrated in FIG. 2 that is formed as a stacking type header. However, the functions of the first distributor 2 manufactured by the lost-wax process are the same as those of the first distributor 2 formed as the stacking type header.

<Flow of Refrigerant in First Distributor 2>

Figure 8:
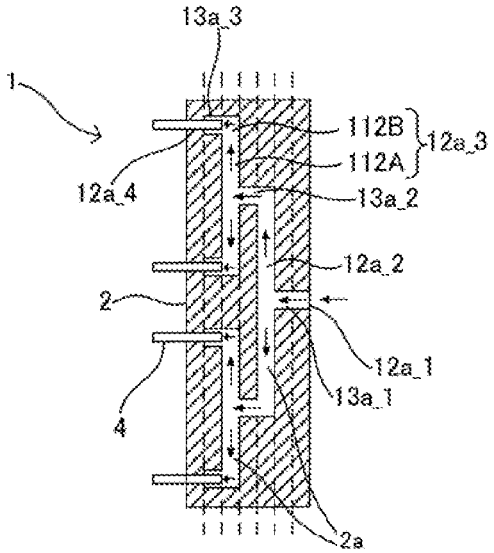
FIG. 8 is a vertical sectional view illustrating the flow of refrigerant in the distributor manufactured by the method illustrated in FIG. 7.

The flow of refrigerant in the first distributor 2 will be described. FIG. 8 is a vertical sectional view illustrating the flow of refrigerant in the distributor manufactured by the method indicated in FIG. 7. In FIG. 8, elements or portions corresponding to those of the first distributor 2 as illustrated in FIG. 2 are denoted by the same reference signs. In FIG. 8, broken lines indicate a correspondence between the first distributor 2 as illustrated therein and the first distributor 2 as illustrated in FIG. 2. Furthermore, as a matter of convenience for explanation, FIG. 8 illustrates the plate-shaped elements having substantially the same thickness. In addition, the cross section as illustrated in FIG. 8 is taken in the flow direction of the fluid.

The flow of the refrigerant is basically the same as or similar to the flow of the refrigerant in the first distributor 2 provided as a stacking type header described above with reference to FIGS. 5 and 6.

The refrigerant having flowed through the refrigerant pipe flows into the first distributor 2 through the through hole 12*a*_1 of the first distributor 2, which serves as the fluid inlet. The refrigerant having flowed through the through hole 12*a*_1 flows through the through hole 13*a*_1, and then flows into the center of the through hole 12*a*_2. The refrigerant having flowed into the center of the through hole 12*a*_2 is divided into refrigerant streams, which flow toward the ends of the through hole 12*a*_2. After reaching the ends of the through hole 12*a*_2, the refrigerant streams flow through the through holes 13*a*_2, and then flows into the centers of the through holes 12*a*_3.

Each of the refrigerant streams having flowed into the centers of the through holes 12*a*_3 is also divided into further refrigerant streams, which flow toward the ends of an associated one of the through holes 12*a*_3. The linear portions 112B provided at the ends of the through holes 12*a*_3 function as the fluid outlets, and the further refrigerant streams having reached the ends of the through holes 12*a*_3 flows into the heat transfer tubes 4 from the end portions 4*a* of the heat transfer tubes 4 located in the through holes 13*a*_3 or in the through holes 12*a*_3.

The refrigerant streams having flowed into the heat transfer tubes 4 pass through the through holes 13*a*_3 and the through holes 12*a*_4, and flow into regions in which the heat transfer tubes 4 are joined to the fins 5.

<Advantages of First Distributor 2 and Heat Exchanger 1>

As described above, in the first distributor 2, the end portions of the distribution flow passage 2*a* are provided as the linear portions 112B, whereby the length of the first distributor 2 in the flow direction of the refrigerant can be reduced. For example, the number of plate-shaped elements included in the first distributor 2 as illustrated in FIG. 2 can be reduced, and the thickness of the first distributor 2 in the stacking direction of the plate-shaped elements can be reduced. Also, the length of the first distributor 2 as illustrated in FIG. 8 in the flow direction of the refrigerant may be made to be nearly equal to that of the first distributor 2 as illustrated in FIG. 2. Thus, with respect to the first distributor 2, the cost can be reduced, and the size and weight can also be reduced.

The heat exchanger 1 is formed to include the first distributor 2. Thus, the manufacturing cost of the first distributor 2 and the heat exchanger 1 can be reduced. In addition, the size and weight can also be reduced.

<Modification>

Figure 9:
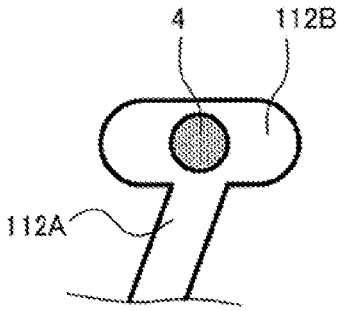
FIG. 9 is a schematic diagram illustrating modification 1 of the heat exchanger according to embodiment 1 of the present invention.

FIG. 9 is a schematic diagram illustrating modification 1 of the heat exchanger 1.

Although in the above description made with reference to FIG. 2, etc., it is assumed by way of example that the heat transfer tubes 4 are flat tubes, the heat transfer tubes 4 may be circular tubes as illustrated in FIG. 9. To be more specific, it suffices that the heat transfer tubes 4 are formed such that the opening area of each of the linear portions 112B is greater than the opening area of each of the end portions of the heat transfer tubes 4.

Figure 10:
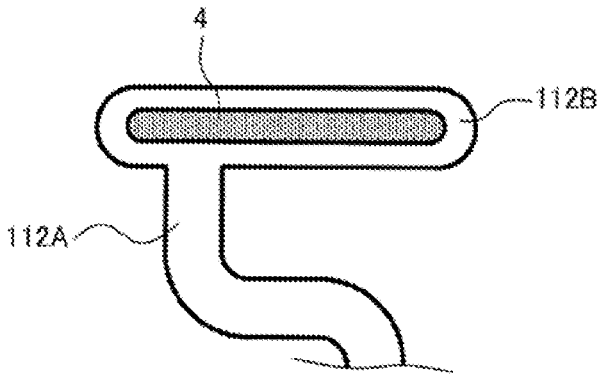
FIG. 10 is a schematic diagram illustrating modification 2 of the heat exchanger according to embodiment 1 of the present invention.

FIG. 10 is a schematic diagram illustrating modification 2 of the heat exchanger 1.

Although in the above description made with reference to FIG. 2, etc., it is assumed by way of example that the Z-shaped portion 112A is continuous with centers of the linear portions 112B which are located at the centers in the longitudinal direction thereof, the Z-shaped portion 112A may be continuous with portions of the linear portions 112B which are other than the centers of the linear portions 112B in the longitudinal direction thereof, as illustrated in FIG. 10.

Embodiment 2

A distributor according to embodiment 2 of the present invention will be described.

Embodiment 2 will be described mainly by referring to the difference between embodiments 1 and 2. Components which are the same as those in embodiment 1 will be denoted by the same reference signs, and their descriptions will thus be omitted.

A heat exchanger including the distributor according to embodiment 2 is the same as or similar to the heat exchanger 1 as described with respect to embodiment 1, and its description will thus be omitted. A distributor according to embodiment 2 will be referred to as a first distributor 2A.

<Configuration of Distributor in Embodiment 2>

The configuration of the first distributor 2A will be described. It is assumed that the first distributor 2A is a stacking type header. The first distributor 2A may be an integration type header. In such a case, the first distributor 2A may be manufactured by the method indicated in FIG. 7.

Figure 11:
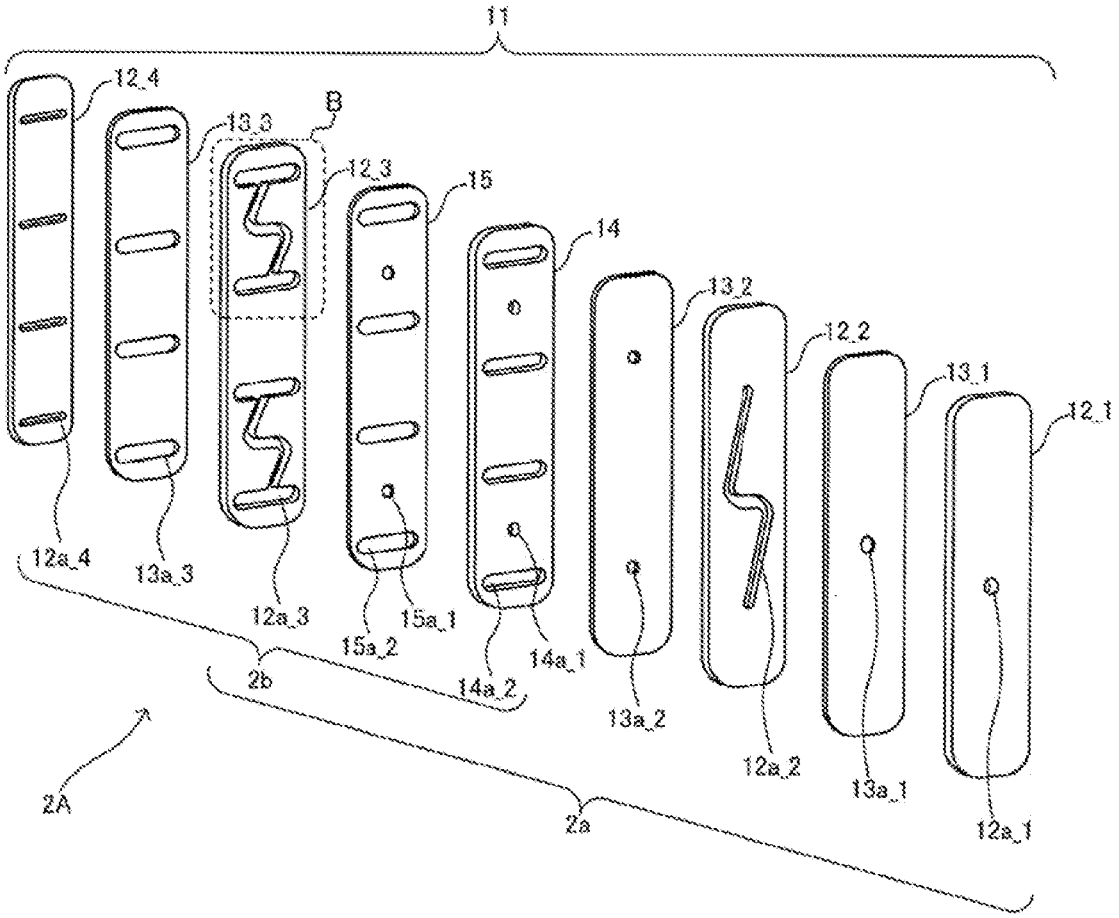
FIG. 11 is an exploded perspective view of a distributor according to embodiment 2 of the present invention.
Figure 12:
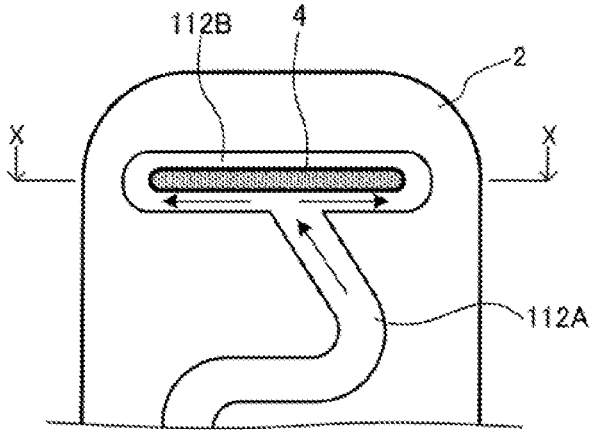
FIG. 12 is an enlarged view of part B in FIG. 11 as viewed from the inlet side of the flow passage.
Figure 13:
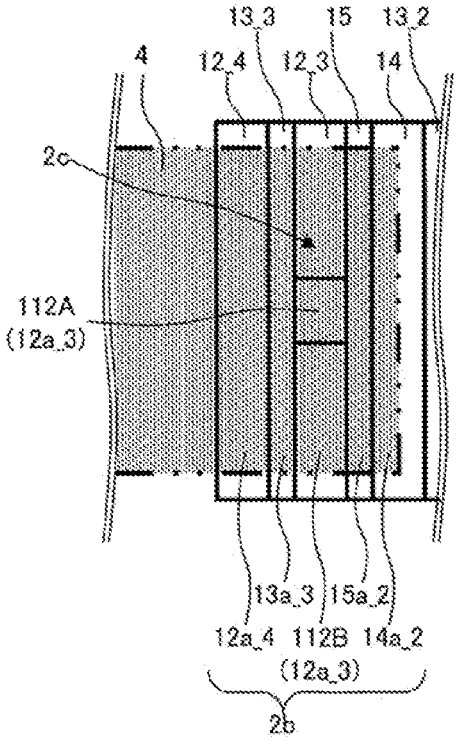
FIG. 13 is an enlarged view of a portion of the distributor according to embodiment 2 of the present invention to which a heat transfer tube is connected.

FIG. 11 is an exploded perspective view of the first distributor 2A. FIG. 12 is an enlarged view of part B indicated in FIG. 11 as seen from the inlet side of the flow passage. FIG. 13 is an enlarged view of a portion of the first distributor 2A, to which a heat transfer tube 4 is connected. FIG. 12 also illustrates the heat transfer tube 4. FIG. 13 is a sectional view taken along line X-X in FIG. 12 as seen from above in a direction perpendicular to the plane of FIG. 12.

As illustrated in FIG. 11, the first distributor 2A includes a plate-shaped body 11. The plate-shaped body 11 is formed by stacking first plate-shaped elements 12_1 to 12_4, which serve as bare elements, second plate-shaped elements 13_1 to 13_3, which serve as clad elements, a third plate-shaped member 14, which serves as a bare member, and a fourth plate-shaped member 15, which serves as a clad member. The first plate-shaped elements 12_1 and 12_4 are provided at the outermost sides of the plate-shaped body 11 in the stacking direction. In the following description, the first plate-shaped elements 12_1 to 12_4 may be generically referred to as first plate-shaped elements 12. Similarly, the second plate-shaped elements 13_1 to 13_3 may be generically referred to as second plate-shaped elements 13.

The first plate-shaped elements 12 and the second plate-shaped elements 13 are configured as described above with respect to those of embodiment 1.

The third plate-shaped member 14 is made of, for example, aluminum, and no brazing material is applied thereto as in the first plate-shaped elements 12. Through holes 14*a*_1 and 14*a*_2, which are included in the distribution flow passage 2*a*, are provided in the third plate-shaped member 14. The through holes 14*a*_1 and 14*a*_2 extend through the third plate-shaped member 14. When the first to fourth plate-shaped elements 12 to 15 are stacked together, the through holes 14*a*_1 and 14*a*_2 serve as part of the distribution flow passage 2*a*.

The through holes 14*a*_2 serve as fluid outlets for fluid such as refrigerant. In other words, the through holes 14*a*_2 are formed as opening portions located at ends of the distribution flow passage 2*a*, and serve as the fluid outlets.

The fourth plate-shaped member 15 is made of, for example, aluminum, and is thinner than the first plate-shaped elements 12, as well as the second plate-shaped elements 13. To at least front and back surfaces of the fourth plate-shaped member 15, a brazing material is applied. The fourth plate-shaped member 15 is provided with through holes 15*a*_1 and 15*a*_2, which form part of the distribution flow passage 2*a*.

The through holes 15*a*_1 and 15*a*_2 extend through the fourth plate-shaped member 15. When the first to fourth plate-shaped elements 12 to 15 are stacked together, the through holes 15*a*_1 and 15*a*_2 function as part of the distribution flow passage 2*a*.

The through holes 14*a*_1 in the third plate-shaped member 14 and the through holes 15*a*_1 in the fourth plate-shaped member 15 are provided to extend through the third and fourth plate-shaped members 14 and 15, respectively, in such a way as to have flow-passage circular cross sections, as well as the through holes 12*a*_1, 13*a*_1, and 13*a*_2.

The through holes 15*a*_1 of the fourth plate-shaped member 15, which is stacked on the first plate-shaped member 12_3, are located to face the centers of the through holes 12*a*_3. The through holes 14*a*_1 of the third plate-shaped member 14, which is stacked on the fourth plate-shaped member 15, are located to face the through holes 15*a*_1.

The through holes 15*a*_2 of the fourth plate-shaped member 15, which is stacked on the first plate-shaped member 12_3, are located to face the linear portions 112B of the through holes 12*a*_3. The through holes 14*a*_2 of the third plate-shaped member 14, which is stacked on the fourth plate-shaped member 15, are located to face the through holes 15*a*_2.

When the first to fourth plate-shaped elements 12 to 15 are stacked together, the through holes provided in the first to fourth plate-shaped elements 12 to 15 communicate with each other to form the distribution flow passage 2*a*. To be more specific, when the first to fourth plate-shaped elements 12 to 15 are stacked together, adjacent ones of the through holes communicate with each other, and each of portions of the first to fourth plate-shaped elements 12 to 15 that are other than the through holes communicating with each other is blocked by the plate-shaped element adjacent to each of the above portions, that is, the first plate-shaped element 12, the second plate-shaped element 13, the third plate-shaped member 14 or the fourth plate-shaped member 15. As a result, the distribution flow passage 2*a* is provided.

With respect to the first distributor 2A, although it is illustrated that the distribution flow passage 2*a* includes a single fluid inlet and four fluid outlets, the number of branches, that is, the number of fluid outlets, is not limited to four.

As illustrated in FIGS. 11 and 13, the through holes 12*a*_4 of the first plate-shaped member 12_4, the through holes 13*a*_3 of the second plate-shaped member 13_3, the through holes 12*a*_3 of the first plate-shaped member 12_3, the through holes 14*a*_2 of the third plate-shaped member 14 and the through holes 15*a*_2 of the fourth plate-shaped member 15 are located in such a way as to face the through holes 14*a*_2 of the third plate-shaped member 14, and serve as the heat-transfer-tube insertion portions 2*b* into which the end portions 4*a* of the heat transfer tubes 4 are inserted. In other words, the through holes 12*a*_4, 13*a*_3, 12*a*_3, 14*a*_2 and 15*a*_2 are located to face the linear portions 112B, which are located on extensions of the heat transfer tubes 4. The heat transfer tubes 4 are inserted into the through holes 12*a*_4, 13*a*_3, 12*a*_3, 14*a*_2 and 15*a*_2, and are thereby connected to the first distributor 2.

The end portions 4*a* of the heat transfer tubes 4 are located in intermediate regions of the through holes 14*a*_2 of the third plate-shaped member 14. To be more specific, the end portions 4*a* of the heat transfer tubes 4 are located at the intermediate regions of the through holes 14*a*_2 of the third plate-shaped member 14, which is adjacent to the second plate-shaped member 13_2, such that the end portions 4*a* of the heat transfer tubes 4 are not in contact with the second plate-shaped member 13_2. Thus, the end portions 4*a* of the heat transfer tubes 4 are closer to the fluid inlet than the through holes 12*a*_3. The through holes 12*a*_3 serve as intermediate portions 2*c* of the heat-transfer-tube insertion portions 2*b*.

<Flow of Refrigerant in First Distributor 2A>

The flow of refrigerant in the first distributor 2A will be described.

Figure 14:
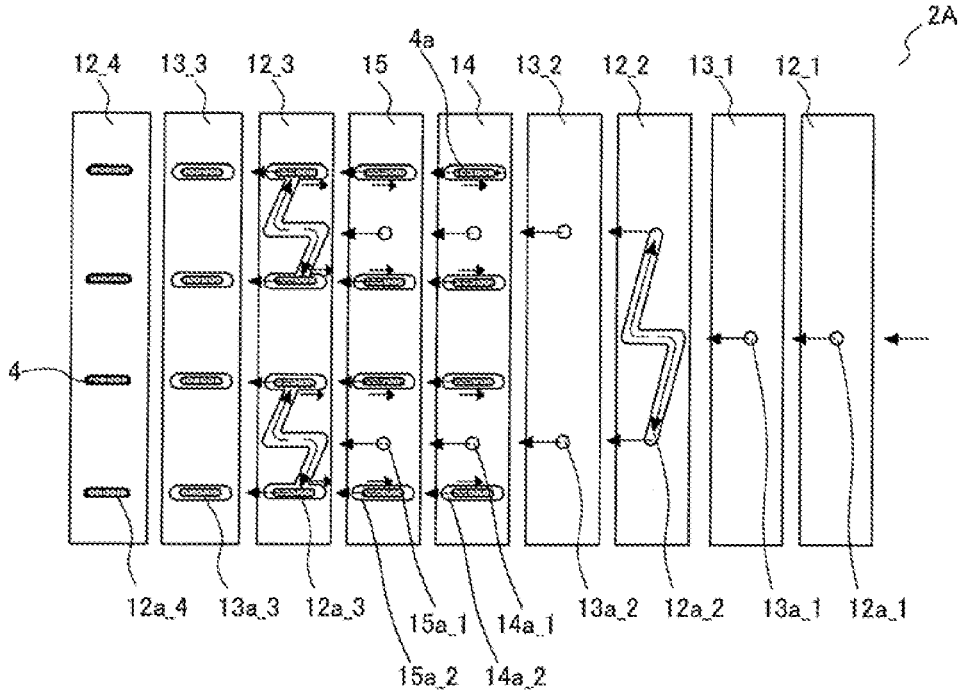
FIG. 14 is a development view of the distributor according to embodiment 2 of the present invention.
Figure 15:
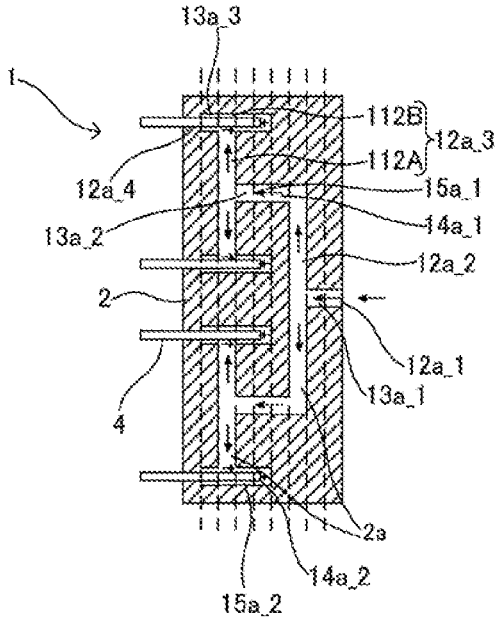
FIG. 15 is a vertical sectional view of the distributor according to embodiment 2 of the present invention.

FIG. 14 is a development view of the first distributor 2A. FIG. 15 is a vertical sectional view of the first distributor 2A. As a matter of convenience for explanation, FIG. 15 schematically illustrates the plate-shaped bodies having substantially the same thickness. The cross section as illustrated in FIG. 15 is taken along the flow direction of the fluid.

As illustrated in FIGS. 14 and 15, the refrigerant having flowed through the refrigerant pipe flows into the first distributor 2 through the through hole 12*a*_1 of the first plate-shaped member 12_1, that serves as a fluid inlet. The refrigerant having flowed through the through hole 12*a*_1 flows into the through hole 13*a*_1 of the second plate-shaped member 13_1.

The refrigerant having flowed into the through hole 13*a*_1 of the second plate-shaped member 13_1 through the through hole 12*a*_1 of the first plate-shaped member 12_1 flows into the center of the through hole 12*a*_2 of the first plate-shaped member 12_2. The refrigerant having flowed into the center of the through hole 12*a*_2 of the first plate-shaped member 12_2 flows onto a surface of the second plate-shaped member 13_2, which is stacked on the first plate-shaped member 12_2, and is divided into refrigerant streams, which flow toward the ends of the through hole 12*a*_2 of the first plate-shaped member 12_2. The refrigerant streams having reached the ends of the through hole 12*a*_2 of the first plate-shaped member 12_2 flow through the through holes 13*a*_2 of the second plate-shaped member 13_2, and then flow into the through holes 14*a*_1 of the third plate-shaped member 14.

The refrigerant streams having flowed into the through holes 14*a*_1 of the third plate-shaped member 14 flow into the through holes 15*a*_1 of the fourth plate-shaped member 15. The refrigerant streams having flowed into the through holes 15*a*_1 of the fourth plate-shaped member 15 flow into the centers of the through holes 12*a*_3 of the first plate-shaped member 12_3.

Each of the refrigerant having flowed into the centers of the through holes 12*a*_3 of the first plate-shaped member 12_3*a*_3 flows onto a surface of the second plate-shaped member 13_3, which is stacked on the first plate-shaped member 12_3, and is also divided into further refrigerant streams, which flow toward the ends of an associated one of the through holes 12*a*_3 of the first plate-shaped member 12_3. The further refrigerant streams having reached the linear portions 112B provided at the ends of the through holes 12*a*_3 of the first plate-shaped member 12_3 flow onto side surfaces of the heat transfer tubes 4 which extend through the through holes 12*a*_3. Since the through holes 12*a*_3 serve as the intermediate portions 2*c* of the heat-transfer-tube insertion portions 2*b*, the refrigerant streams having flowed onto the side surfaces of the heat transfer tubes 4 in the through holes 12*a*_3 flow into the through holes 15*a*_2 of the fourth plate-shaped member 15, and then flow toward the fluid inlet, not toward the through holes 12*a*_3.

The refrigerant streams having flowed into the through holes 15*a*_2 of the fourth plate-shaped member 15 flows into the through holes 14*a*_2 of the third plate-shaped member 14. The through holes 14*a*_2 of the third plate-shaped member 14 serve as fluid outlets, and the refrigerant streams having flowed into the through holes 14*a*_2 of the third plate-shaped member 14 flow into the heat transfer tubes 4 from the end portions 4*a* of the heat transfer tubes 4 which are located in the through holes 14*a*_2.

The refrigerant streams having flowed into the heat transfer tubes 4 pass through the through holes 14*a*_2 of the third plate-shaped member 14, the through holes 15*a*_2 of the fourth plate-shaped member 15, the through holes 12*a*_3 of the first plate-shaped member 12_3, the through holes 13*a*_3 of the second plate-shaped member 13_3, and the through holes 12*a*_4 of the first plate-shaped member 12_4, and flow into the regions in which the heat transfer tubes 4 are joined to the fins 5.

Each of the refrigerant streams having reached the linear portions 112B provided at the ends of the through holes 12*a*_3 of the first plate-shaped member 12_3 flows leftwards and rightwards as illustrated in FIG. 12 after flowing onto a side surface of an associated one of the heat transfer tubes 4.

In an operation mode in which the heat exchanger 1 functions as an evaporator, each of the refrigerant streams having reached the linear portions 112B is in a two-phase gas-liquid state, and is dispersed when flowing onto the side surface of the associated heat transfer tube 4. Since the refrigerant is dispersed, in the intermediate portions 2*c* of the heat-transfer-tube insertion portions 2*b*, the gas phase and liquid phase of the refrigerant are equivalently balanced. The refrigerant made to be in such an equivalently balanced two-phase gas-liquid state flows into the heat transfer tubes 4.

On the other hand, in an operation mode in which the heat exchanger 1 functions as a condenser, the refrigerant flows into the first distributor 2A through the through holes 14*a*_2 which serve as fluid outlets, flows through the distribution flow passage 2*a*, and then flows out of the distribution flow passage 2*a* through the through hole 12*a*_1 which serves as a fluid inlet. In the operation mode in which the heat exchanger 1 functions as the condenser, the refrigerant which flows into the first distributor 2A is substantially entirely in a liquid phase.

<Advantages of First Distributor 2A and Heat Exchanger 1>

As described above, the heat exchanger according to embodiment 2 includes the first distributor 2A, and thus obtains not only the advantage of the heat exchanger 1 according to embodiment 1, but the following advantages. The refrigerant being in the equivalently balanced two-phase gas-liquid state can be made to flow into the heat transfer tubes 4, the thickness of liquid films on inner surfaces of the heat transfer tubes 4 is reduced, and the coefficient of heat transfer is improved. Therefore, in the heat exchanger according to embodiment 2, the heat exchanger performance is improved.

Furthermore, in the heat exchanger according to embodiment 2, in the case where the heat transfer tubes 4 are flat perforated tubes, the refrigerant being in the equivalently balanced two-phase gas-liquid state flows into holes of the heat transfer tubes 4, and can thus be efficiently evaporated in a heat exchange unit. Therefore, in the heat exchanger according to embodiment 2, the heat exchanger performance is improved, and the operation can be performed at a high efficiency.

Furthermore, in the operation mode in which the heat exchanger functions as the condenser, since the heat transfer tubes 4 are inserted to reach the through holes 14*a*_2 of the third plate-shaped member 14, the actual volume of the heat-transfer-tube insertion portions 2*b* can be reduced, and the amount of refrigerant staying in the heat-transfer-tube insertion portions 2*b* can be reduced. As a result, the total amount of refrigerant provided in the refrigeration cycle apparatus can be reduced. Thus, the refrigeration cycle apparatus is economical, and is advantageous in terms of environmental protection for leakage of refrigerant.

Modifications 1 and 2 of embodiment 1 as illustrated in FIGS. 9 and 10 may also be applied to embodiment 2.

The intermediate portions 2*c* do not mean exact middle portions of the heat-transfer-tube insertion portions 2*b*. It suffices that the intermediate portions 2*c* are provided as portions in which the side surfaces of the heat transfer tubes 4 inserted in the heat-transfer-tube insertion portions 2*b* are located.

Embodiment 3

A refrigeration cycle apparatus according to embodiment 3 of the present invention will be described.

<Configuration of Refrigeration Cycle Apparatus 100>

The configuration of a refrigeration cycle apparatus 100 according to embodiment 3 will be roughly described.

Figure 16:
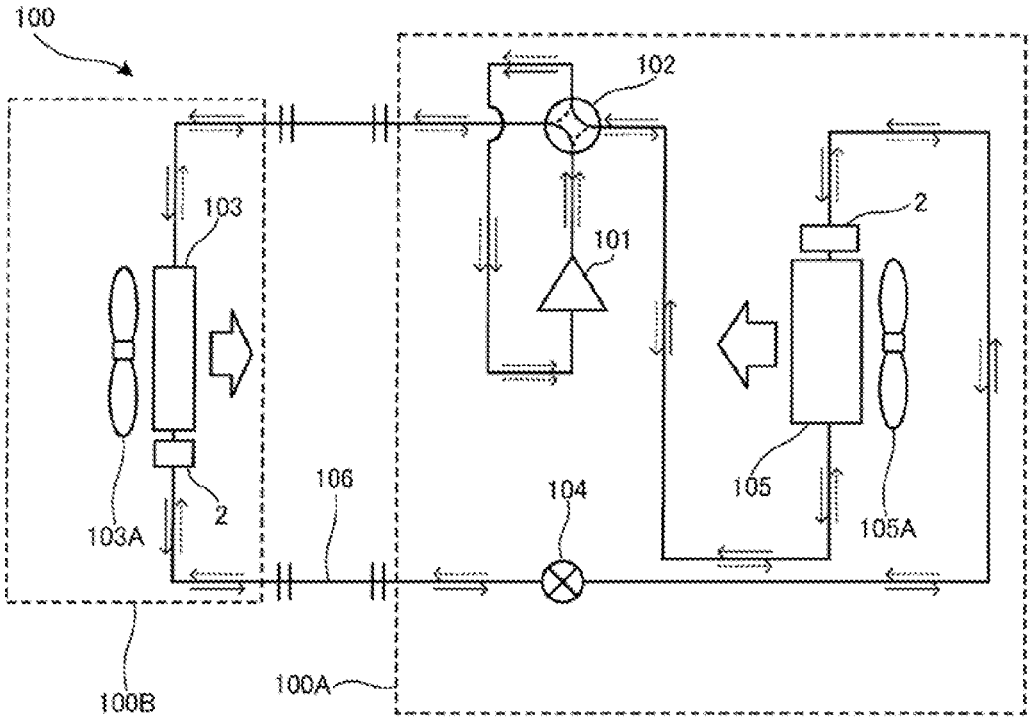
FIG. 16 is a schematic circuit diagram illustrating an example of a refrigerant circuit configuration of a refrigeration cycle apparatus according to embodiment 3 of the present invention.

FIG. 16 is a schematic circuit diagram illustrating an example of a refrigerant circuit configuration of the refrigeration cycle apparatus 100 according to embodiment 3. Embodiment 3 will be described mainly by referring to the differences between embodiment 3 and embodiments 1 and 2. Components which are the same as those in embodiments 1 and 2 will be denoted by the same reference signs, and their descriptions will thus be omitted. In FIG. 16, the flow of refrigerant in the cooling operation is indicated by dashed arrows, and the flow of refrigerant in the heating operation is indicated by solid arrows. The flow of air is indicated by outlined arrows.

The refrigeration cycle apparatus 100 includes a heat exchanger including the distributor according to embodiment 1 or 2. As a matter of convenience for explanation, it is assumed that the refrigeration cycle apparatus 100 includes the heat exchanger 1 including the first distributor 2 according to embodiment 1. In addition, in embodiment 3, it is assumed that the refrigeration cycle apparatus 100 is an air-conditioning apparatus.

The refrigeration cycle apparatus 100 includes a first unit 100A and a second unit 100B. The first unit 100A is used as, for example, a heat source unit or an outdoor unit. The second unit 100B is used as, for example, an indoor unit or a use-side unit (load-side unit).

The first unit 100A includes a compressor 101, a flow-passage switching device 102, an expansion device 104, a second heat exchanger 105, and a fan 105A provided close to the second heat exchanger 105. The second heat exchanger 105 includes the first distributor 2. Thus, the second heat exchanger 105 corresponds to the heat exchanger 1 according to embodiment 1.

The second unit 100B includes a first heat exchanger 103 and a fan 103A provided close to the first heat exchanger 103. The first heat exchanger 103 further includes the first distributor 2. Thus, the first heat exchanger 103 corresponds to the heat exchanger 1 according to embodiment 1.

As illustrated in FIG. 16, the compressor 101, the first heat exchanger 103, the expansion device 104 and the second heat exchanger 105 are connected to each other by a refrigerant pipe 106, whereby a refrigerant circuit is formed. The fan 103A is provided close to the first heat exchanger 103, and sends air to the first heat exchanger 103. The fan 105A is provided close to the second heat exchanger 105, and sends air to the second heat exchanger 105.

The compressor 101 compresses the refrigerant. The refrigerant compressed by the compressor 101 is discharged, and supplied to the first heat exchanger 103 or the second heat exchanger 105. As the compressor 101, for example, a rotary compressor, a scroll compressor, a screw compressor or a reciprocating compressor can be applied.

The flow-passage switching device 102 switches the flow of the refrigerant between that for the heating operation and that for the cooling operation. More specifically, in the heating operation, the flow-passage switching device 102 switches the flow of the refrigerant in such a way as to connect the compressor 101 to the first heat exchanger 103, and in the cooling operation, the flow-passage switching device 102 switches the flow of the refrigerant in such a way as to connect the compressor 101 to the second heat exchanger 105. It is appropriate that as the flow-passage switching device 102, for example, a four-way valve is applied. As the flow-passage switching device 102, a combination of two-way and three-way valves may be applied.

The first heat exchanger 103 functions as a condenser in the heating operation, and as an evaporator in the cooling operation. To be more specific, when the first heat exchanger 103 functions as a condenser, high-temperature high-pressure refrigerant discharged from the compressor 101 exchanges heat with air sent by the fan 103A in the first heat exchanger 103, so that the high-temperature high-pressure gas refrigerant is condensed. When the first heat exchanger 103 functions as an evaporator, low-temperature low-pressure refrigerant discharged from the expansion device 104 exchanges heat with air sent by the fan 103A in the first heat exchanger 103, so that the low-temperature low-pressure liquid or two-phase refrigerant is evaporated.

The expansion device 104 causes the refrigerant discharged from the first heat exchanger 103 or the second heat exchanger 105 to expand so that the pressure of the refrigerant is reduced. It is appropriate that as the expansion device 104, for example, an electric expansion valve capable of adjusting the flow rate of the refrigerant is applied. Also, as the expansion device 104, a mechanical expansion valve employing a diaphragm as a pressure receiver, a capillary tube or the like can be applied.

The second heat exchanger 105 functions as an evaporator in the heating operation, and as a condenser in the cooling operation. When the second heat exchanger 105 functions as an evaporator, low-temperature low-pressure refrigerant discharged from the expansion device 104 exchanges heat with air sent by the fan 105A in the second heat exchanger 105, so that the low-temperature low-pressure liquid or two-phase refrigerant is evaporated. When the second heat exchanger 105 functions as a condenser, high-temperature high-pressure refrigerant discharged from the compressor 101 exchanges heat with air sent by the fan 105A in the second heat exchanger 105, so that the high-temperature high-pressure gas refrigerant is condensed.

<Operation of Refrigeration Cycle Apparatus 100>

The operation of the refrigeration cycle apparatus 100 will be described along with the flow of the refrigerant. In the following description of the operation of the refrigeration cycle apparatus 100, it is assumed that the heat exchange fluid is air, and fluid with which the heat exchange fluid exchanges heat is refrigerant.

First, the cooling operation to be performed by the refrigeration cycle apparatus 100 will be described. The flow of the refrigerant during the cooling operation is indicated by dashed arrows in FIG. 16.

Referring to FIG. 16, when the compressor 101 is activated, high-temperature high-pressure gas refrigerant is discharged from the compressor 101. Thereafter, the refrigerant flows as indicated by dashed arrows. The high-temperature high-pressure gas refrigerant (single phase) discharged from the compressor 101 passes through the flow-passage switching device 102 and flows into the second heat exchanger 105, which functions as a condenser. In the second heat exchanger 105, the high-temperature high-pressure gas refrigerant having flowed thereinto exchanges heat with air sent by the fan 105A, so that the high-temperature high-pressure gas refrigerant is condensed into high-pressure liquid refrigerant (single phase).

The high-pressure liquid refrigerant discharged from the second heat exchanger 105 is changed into low-pressure two-phase gas-liquid refrigerant by the expansion device 104. The two-phase gas-liquid refrigerant flows into the first heat exchanger 103, which functions as an evaporator. The first heat exchanger 103 is provided with the first distributor 2. The first distributor 2 distributes the refrigerant as refrigerant streams the number of which corresponds to the number of paths in the first heat exchanger 103. The refrigerant streams flow into the heat transfer tubes 4 included in the first heat exchanger 103.

The two-phase gas-liquid refrigerant having flowed into the first heat exchanger 103 exchanges heat with air sent by the fan 103A in the first heat exchanger 103. Thereby, liquid refrigerant is evaporated from the two-phase gas-liquid refrigerant, and as a result the two-phase gas liquid refrigerant is changed into low-pressure gas refrigerant (single phase). The low-pressure gas refrigerant discharged from the first heat exchanger 103 flows into the compressor 101 through the flow-passage switching device 102, and is compressed into high-temperature high-pressure gas refrigerant, and the high-temperature high-pressure gas refrigerant is discharged from the compressor 101. Thereafter, the above cycle is repeated.

Next, the heating operation to be performed by the refrigeration cycle apparatus 100 will be described. The flow of the refrigerant during the heating operation is indicated by the solid arrows in FIG. 16.

Referring to FIG. 16, when the compressor 101 is activated, high-temperature high-pressure gas refrigerant is discharged from the compressor 101. Then, the refrigerant flows as indicated by the solid arrows. The high-temperature high-pressure gas refrigerant (single phase) discharged from the compressor 101 passes through the flow-passage switching device 102, and flows into the first heat exchanger 103, which functions as a condenser. In the first heat exchanger 103, the high-temperature high-pressure gas refrigerant having flowed thereinto exchanges heat with air sent by the fan 103A, so that the high-temperature high-pressure gas refrigerant is condensed into high-pressure liquid refrigerant (single phase).

The high-pressure liquid refrigerant discharged from the first heat exchanger 103 is changed into low-pressure two-phase gas-liquid refrigerant by the expansion device 104. The two-phase gas-liquid refrigerant flows into the second heat exchanger 105, which functions as an evaporator. The second heat exchanger 105 is provided with the first distributor 2. The first distributor 2 distributes the refrigerant as refrigerant streams the number of which corresponds to the number of paths in the second heat exchanger 105. The refrigerant streams flow into the heat transfer tubes 4 included in the second heat exchanger 105.

In the second heat exchanger 105, the two-phase refrigerant having flowed thereinto exchanges heat with air sent by the fan 105A. As a result, the liquid refrigerant is evaporated from the two-phase refrigerant, and as a result the two-phase refrigerant is changed into low-pressure gas refrigerant (single phase). The low-pressure gas refrigerant discharged from the second heat exchanger 105 flows into the compressor 101 through the flow-passage switching device 102, and is compressed into high-temperature high-pressure gas refrigerant, and the high-temperature high-pressure gas refrigerant is discharged from the compressor 101. Thereafter, the above cycle is repeated.

As described above, in the refrigeration cycle apparatus 100, the first distributor 2 is located upstream of the first heat exchanger 103 and the second heat exchanger 105.

Therefore, in the refrigeration cycle apparatus 100, the manufacturing cost of the first heat exchanger 103 and the second heat exchanger 105 can be reduced, and the size and weight of the heat exchanger 1 can also be reduced.

In the case where the first heat exchanger 103 and the second heat exchanger 105 of the refrigeration cycle apparatus 100 are each provided with the first distributor 2A according to embodiment 2, the heat exchanger performance can be further improved.

Although it is described above by way of example that as each of the first heat exchanger 103 and the second heat exchanger 105, the heat exchanger according to embodiment 1 or the heat exchanger according to embodiment 2 is applied, the heat exchanger according to embodiment 1 and the heat exchanger according to embodiment 2 may be applied as at least one of the first heat exchanger 103 and the second heat exchanger 105.

The refrigerant for use in the refrigeration cycle apparatus 100 is not particularly limited. Even in the case where as the refrigerant, for example, R410A, R32, or HFO1234yf is used, the same advantages as described above can be obtained.

Although air and refrigerant are described as examples of operating fluid, the operating fluid is not limited to them. Even in the case where any of other kinds of gas, liquid or gas-liquid mixed fluid is applied, the same advantages as described above can be obtained. That is, since the operating fluid varies, in the case where any of the above gas, liquid and mixed fluid is applied, the same advantage as described above can be obtained.

Furthermore, as other examples of the refrigeration cycle apparatus 100, a water heater, a refrigerator and an air-conditioning water-heater multifunction machine are present. The present invention will reduce the cost, size and weight for whichever example is applied. In addition, in the case where the first distributor 2A is provided, the heat exchanging performance can be further improved.

REFERENCE SIGNS LIST

1 heat exchanger 2 first distributor 2_1 mold 2A first distributor 2*a* distribution flow passage 2*a*_1 wax pattern 2*b* heat-transfer-tube insertion portion 2*c* intermediate portion 3 second distributor 3*a* joining flow passage 4 heat transfer tube 4*a* end portion 5 fin 11 plate-shaped body 12 first plate-shaped element 12_1 first plate-shaped element 12_2 first plate-shaped element 12_3 first plate-shaped element 12_4 first plate-shaped element 12*a*_1 through hole 12*a*_2 through hole 12*a*_3 through hole 12*a*_4 through hole 13 second plate-shaped element 13_1 second plate-shaped element 13_2 second plate-shaped element 13_3 second plate-shaped element 13*a*_1 through hole 13*a*_2 through hole 13*a*_3 through hole 14 third plate-shaped element 14*a*_1 through hole 14*a*_2 through hole 15 fourth plate-shaped element 15*a*_1 through hole 15*a*_2 through hole 100 refrigeration cycle apparatus 100A first unit 100B second unit 101 compressor 102 flow-passage switching device 103 first heat exchanger 103A fan 104 expansion device 105 second heat exchanger 105A fan 106 refrigerant pipe 112A Z-shaped portion 112B linear portion

The invention claimed is:

1. A distributor comprising:

a fluid inlet;

a plurality of fluid outlets;

a distribution flow passage configured to cause the fluid inlet to communicate with the fluid outlets, and distribute fluid which flows into the distribution flow passage through the fluid inlet, among the fluid outlets; and a plurality of heat-transfer-tube insertion portions each formed to face an associated one of the fluid outlets, the heat-transfer-tube insertion portions allowing heat transfer tubes to be inserted therein, wherein:

the heat transfer tubes are inserted in the heat-transfer-tube insertion portions such that a distal end portion of each of the heat transfer tubes is connected to an associated fluid outlet, the distribution flow passage includes branch flow passages, a downstream outermost one of which is provided with opening portions, each opening portion respectively having a larger area than an area of the distal end portion of an associated heat transfer tube, and the larger areas of the opening portions allow for communication of the distribution flow passage with intermediate portions of the heat-transfer-tube insertion portions such that fluid flows onto side surfaces of the heat transfer tubes inserted in the heat-transfer-tube insertion portions.

2. The distributor of claim 1, wherein the fluid outlets are provided on an end side of the distribution flow passage in a flow direction of the fluid.

3. The distributor of claim 1, wherein fluid flowing onto the side surfaces of the heat transfer tubes further flows toward the fluid inlet, and wherein the fluid outlets are closer to the fluid inlet than the heat-transfer-tube insertion portions.

4. The distributor of claim 1, wherein the opening portions are in the fluid outlets.

5. The distributor of claim 1, wherein the fluid inlet, the distribution flow passage, the fluid outlets and the heat-transfer-tube insertion portions are provided by stacking a plurality of plate-shaped elements including through holes formed therein.

6. A heat exchanger comprising:

the distributor of claim 1; and a plurality of heat transfer tubes into which the fluid flows after flowing out though the fluid outlets of the distributor.

7. The heat exchanger of claim 6, wherein in the distributor, fluid flowing onto the side surfaces of the heat transfer tubes further flows toward the fluid inlet, and the fluid outlets are closer to the fluid inlet than the heat-transfer-tube insertion portions, and wherein when reaching the intermediate portions of the heat-transfer-tube insertion portions, the fluid is made to flow onto the side surfaces of the heat transfer tubes inserted in the heat-transfer-tube insertion portions, and thereby flows toward the fluid inlet.

8. The heat exchanger of claim 6, wherein the heat transfer tubes are circular tubes or flat tubes.

9. A refrigeration cycle apparatus comprising:

the heat exchanger of claim 6, the heat exchanger functioning as at least one of an evaporator and a condenser.

10. The distributor of claim 1, wherein a cross section of the downstream outermost branch passage has a cross section that is a combination of a Z-shaped portion and two linear portions at the ends of the Z-shape portion.

11. The distributor or claim 10, wherein at least two of the opening portions are formed in portions of the outermost branch passage corresponding to the linear portions.

* * * * *